US005992062A

United States Patent [19]

Evans et al.

[11] Patent Number: 5,992,062

[45] Date of Patent: Nov. 30, 1999

[54] HIGH PENETRATION BUCKET ARRANGEMENT

[75] Inventors: Robert D. Evans, Alma; Gary R. Woerman, Wamego, both of Kans.

[73] Assignee: Caterpillar Inc., Peoria, Ill.

[21] Appl. No.: 08/989,052

[22] Filed: Dec. 11, 1997

[51] Int. Cl.[6] ..... E02F 3/40

[52] U.S. Cl. ..... 37/444; 37/446; 414/722

[58] Field of Search ..... 37/444, 411, 398, 37/446, 448, 452; 414/685, 722, 724

[56] References Cited

U.S. PATENT DOCUMENTS

| | | | |
|---|---|---|---|
| 1,208,054 | 12/1916 | Vanderhoef . | |
| 1,503,866 | 8/1924 | Washburn et al. | 37/444 |
| 2,184,045 | 12/1939 | Jeffrey | 37/141 |
| 2,398,360 | 4/1946 | Daniels et al. . | |
| 2,597,711 | 5/1952 | Donald . | |
| 3,915,238 | 10/1975 | Hubbell . | |
| 4,117,611 | 10/1978 | Hemphill . | |
| 4,616,433 | 10/1986 | Knell et al. | 37/141 T |
| 5,077,918 | 1/1992 | Garman | 37/452 |
| 5,147,011 | 9/1992 | Hvolka | 180/234 |
| 5,353,531 | 10/1994 | Doucette | 37/444 |

*Primary Examiner*—H. Shackelford
*Attorney, Agent, or Firm*—O. Gordon Pence

[57] ABSTRACT

A bucket arrangement for an earthworking machine is provided with a cutting edge plate which is bowed outwardly and has a serrated leading edge such that a center tooth assembly is disposed in a plane of engagement with the soil ahead of and below the plane of engagement of a pair of side tooth assemblies. Thus, the center tooth makes penetrating engagement with the soil prior to the side teeth, providing the bucket arrangement with greater penetrating ability. The ability of the bucket to cut or slice through the soil is also enhanced by the serrated portions of the cutting edge plate.

5 Claims, 2 Drawing Sheets

HIGH PENETRATION BUCKET ARRANGEMENT

TECHNICAL FIELD

The present invention relates to a bucket for excavating machines and the like and, more particularly, to a high penetration bucket arrangement.

BACKGROUND ART

Buckets for excavating machines such as hydraulic excavators, loaders, backhoes and the like typically have a straight cutting edge and/or multiple teeth mounted on such cutting edge that penetrate the ground along a linear line and in a single plane. Such buckets experience difficulty in penetrating the ground when encountering especially hard to penetrate types of soils, such as those with rocks or caliche. Various prior devices have been employed to provide increased penetration. One such device is disclosed in U.S. Pat. No. 2,184,045 for a Cutting Blade, issued Dec. 19, 1939 to C. L. Jeffrey. Another device is disclosed in U.S. Pat. No. 1,503,866 for a Toothed Cutter Lip, issued Aug. 5, 1924 to H. G. Washburn Et. Al. Yet another device is disclosed in U.S. Pat. No. 4,616,433 for a Ripping Bucket Arrangement, issued Oct. 14, 1986 to Harvey A. Knell. The prior attempts either still lack high penetration ability because they do not employ teeth, lack versatility for use in other applications, or add undue complexity and expense to the bucket.

The present invention is directed at overcoming one or more of the problems set forth above.

DISCLOSURE OF THE INVENTION

In accordance with one aspect of the present invention, a bucket arrangement for an earthworking machine is provided with a pair of opposite side plates a moldboard and a cutting edge plate. Each side plate has a leading edge and bottom edge joining the leading edge at a forward corner thereof. The moldboard extends between the side plates along the bottom edge of the side plates and has a forward edge. The forward edge is formed with an outwardly bowed configuration. The cutting edge plate has an inside surface, an opposite outside surface, a leading edge, a trailing edge and opposite ends. The cutting edge plate has its trailing edge attached to the forward edge of the moldboard and its ends attached to respective ones of the forward corners of each side plate. The cutting edge plate is constructed with a predetermined outwardly bowed configuration and has its leading edge extending along a predetermined path between the ends defining a pair of opposite laterally extending end portions, a laterally extending and forwardly projecting center portion and a pair of arcuate serrated portions. Each of such serrated portions extend tangentially from a respective one of the end portions to the center portion.

BEST MODE FOR CARRYING OUT THE INVENTION

Figure 1:
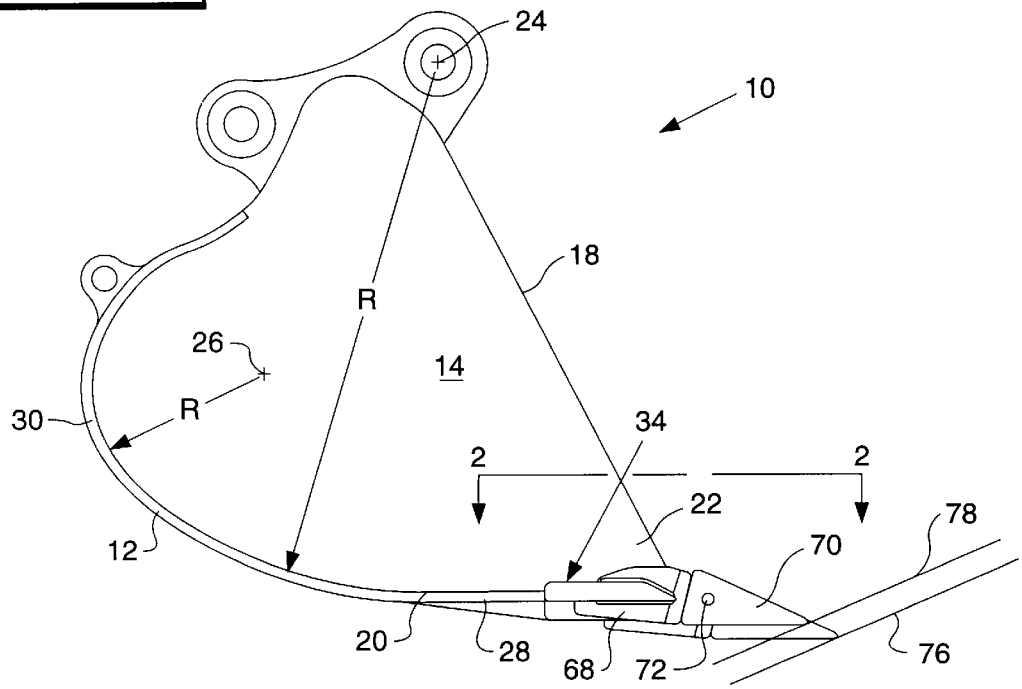
FIG. 1 is a side elevational view of a bucket arrangement embodying the principles of the present invention.
Figure 2:
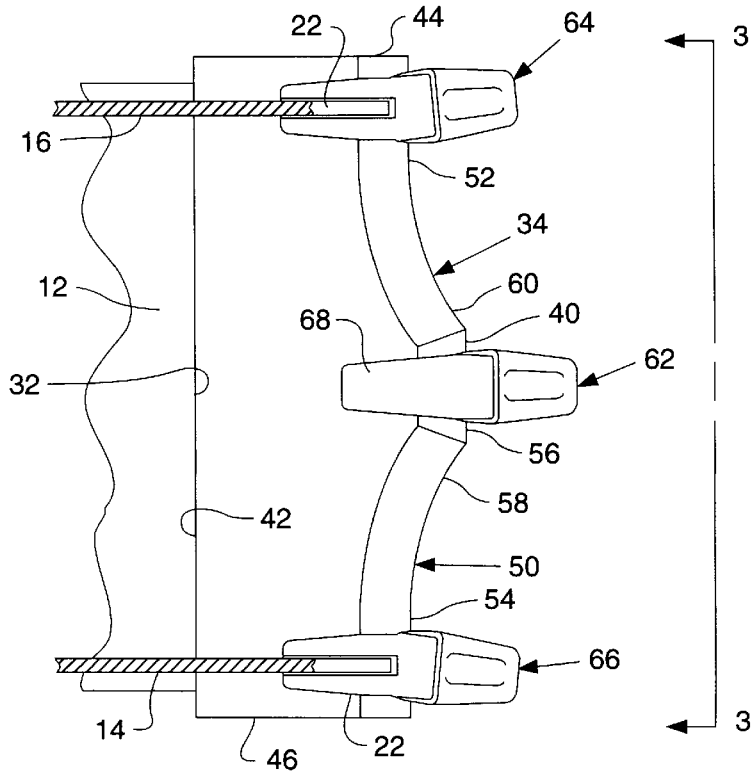
FIG. 2 is a partially sectioned plan view taken generally along line 2—2 of FIG. 1 illustrating the cutting edge plate of the present invention.
Figure 3:
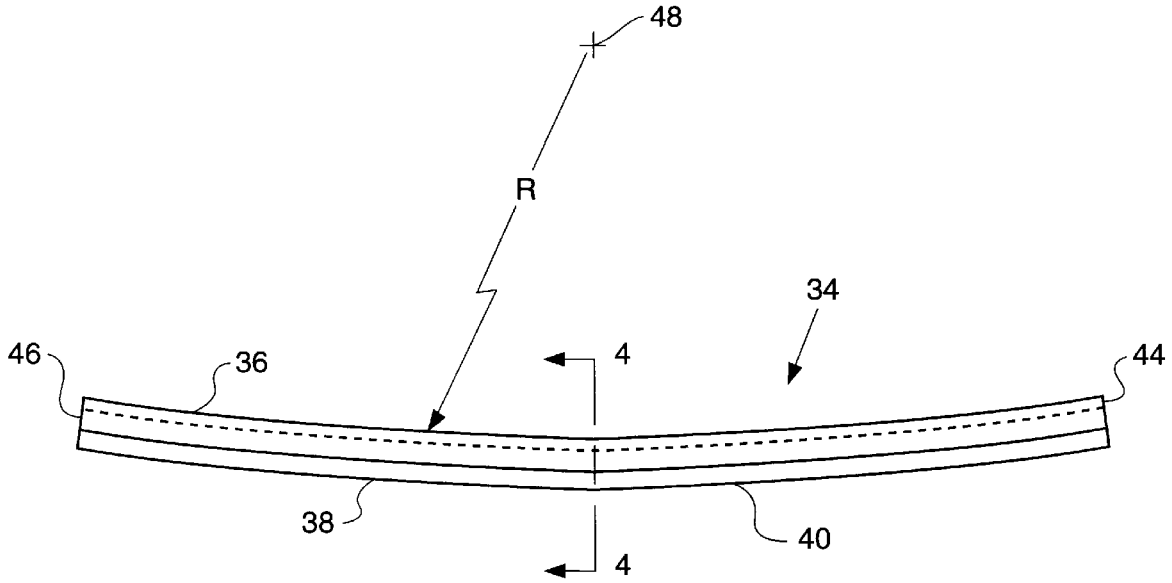
FIG. 3 is a front elevational view of the cutting edge plate of FIG. 2, but without the tooth assemblies attached thereto.
Figure 4:
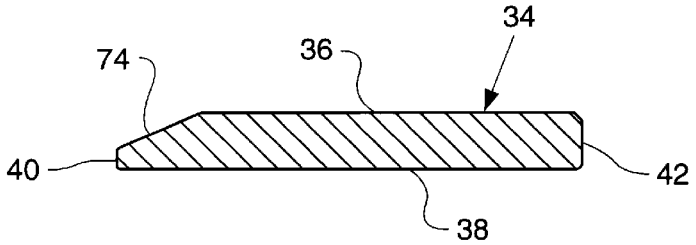
FIG. 4 is a cross-sectional view of the cutting edge plate taken along line 4—4 of FIG. 3.

Referring more particularly to the drawings, a bucket arrangement embodying the principles of the present invention is generally shown at 10 in FIG. 1 for an excavating machine (not shown), such as a hydraulic excavator, backhoe, loader or the like, all of which are well known in the art.

The bucket arrangement 10 has a generally shell-like configuration including a laterally extending, arcuately shaped moldboard 12 and a pair of bucket side plates 14,16. Each side plate 14,16 has a rearwardly sloping forward leading edge 18 and a bottom edge 20 that joins the leading edge 18 at a forward corner 22 thereof. The moldboard 12 extends between the side plates 14,16 is curved about one or more radii having centerlines, such as at 24,26, which extend laterally between the bucket side plates and define a bottom portion 28 and a rearward portion 30. The bottom portion 28 of the moldboard has a forward edge 32.

In accordance with the present invention, the bucket arrangement 10 also includes a cutting edge plate 34 having an inside surface 36, an opposite outside surface 38, a leading edge 40, a trailing edge 42 and opposite ends 44,46. The cutting edge plate 34 extends laterally between the side plates 14,16 and has its trailing edge 42 attached in any suitable manner, such as by welding, to the forward edge 32 of the moldboard 12 and its ends 44,46 similarly attached to respective ones of the forward corners 22 of each side plate 14,16.

The cutting edge plate 34 is constructed with a predetermined outwardly bowed configuration by bending about a predetermined radius of curvature whose centerline 48 is oriented in a direction transverse to the moldboard radius centerlines 24,26. While the cutting edge plate 34 is depicted as being curved about a single radius centerline 48, it should be understood that multiple radii or bends could be used as well without departing from the spirit of the present invention. It should also be noted that the bottom portion 28 of the moldboard 12 is bowed outwardly along its forward edge 32 to match the bowed configuration of the cutting edge plate 34.

In addition, the leading edge 40 of the cutting edge plate 34 is constructed to extend along a predetermined path 50 between the ends 44,46 so as to define a pair of opposite laterally extending end portions 52,54, a laterally extending and forwardly projecting center portion 56 and a pair of arcuate serrated portions 58,60. Each of such serrated portions 58,60 extend tangentially from a respective one of the end portions 52,54 to the center portion 56.

The bucket arrangement 10 also preferably includes a plurality of tooth assemblies, such as a center tooth assembly 62 and a pair of side tooth assemblies 64,66. The center tooth assembly 62 is mounted to the cutting edge plate 34 at the center portion 56 of the leading edge 40. Each of the side tooth assemblies 64,66 are mounted at a respective one of end portions 52,54 of the leading edge 40 to the cutting edge plate 34 and to a respective one of the forward corners 22 of the side plates 14,16 of the bucket 10. Each of the tooth assemblies 62,64,66 preferable includes a tooth adapter 68 and a tooth 70. Each tooth adapter 68 is suitable attached, such as by welding, to the cutting edge plate 34 and, in the case of the side tooth assemblies 64,66, to the forward corners 22. Teeth 70 are carried on their respective adapters 68 and are preferably coupled thereto by a suitable pin retainer 72 or the like.

The leading edge 40 of the cutting edge plate 34 has an acute bevel 74 along its entire length to provide the leading edge with a knife-like sharpness.

Industrial Applicability

The construction of the present bucket arrangement 10 with its bowed and serrated cutting edge plate 34 affords many advantages over prior bucket configurations. The present configuration enables the bucket to penetrate tough soil conditions easier and more effectively with the use of less power from the machine employing such bucket. Bucket penetrate is enhanced by the present configuration because the center tooth assembly 56 is disposed in a different plane of engagement 76 with the soil, which plane is below and ahead of the plane of engagement 78 of the side tooth assemblies 64,66. Thus, the center tooth 62 makes penetrating engagement with the soil prior to the side teeth 64,66. Such initial penetration by a single tooth is easier than having all the teeth penetrating at once. Also, the penetration by the center tooth tends to break the soil apart, making subsequent penetration by the side teeth that much easier. The ability of the bucket 10 to cut or slice through the soil is also enhanced by the serrated portions 58,60 of the cutting edge plate 34.

Other aspects and advantages of the present invention of this invention can be obtained through a study of the drawings, the disclosure and the appended claims.

We claim:

1. A bucket arrangement for an earthworking machine, comprising:

a pair of opposite side plates, each side plate having a leading edge and bottom edge joining said leading edge at a forward corner thereof;

a moldboard extending between said side plates along said bottom edge and having a forward edge, said forward edge being formed with an outwardly bowed configuration; and a cutting edge plate having a leading edge, a trailing edge and opposite ends, said cutting edge plate having its trailing edge attached to the forward edge of said moldboard and its ends attached to respective ones of the forward corners of each side plate and being constructed with a predetermined outwardly bowed configuration about a predetermined radius of curvature, said leading edge extending along a predetermined path between said ends defining a pair of opposite laterally extending end portions, a laterally extending center portion and a pair of arcuate serrated portions, said center portion being located forward of said pair of oppositely laterally extending end portions and each of such serrated portions extending between a respective one of said end portions and said center portion.

2. The bucket arrangement of claim 1 including a center tooth assembly and a pair of side tooth assemblies, said center tooth assembly being mounted to said center portion of said cutting edge plate and said side tooth assemblies each being mounted to a respective one of end portions of said cutting edge plate at a respective one of the forward corners of the side plates of said bucket arrangement.

3. The bucket arrangement of claim 2 wherein said cutting edge plate is configured to place said center tooth assembly in a first plane of engagement and said side tooth assemblies in a second plane of engagement, said first plane of engagement being disposed below and ahead of said second plane of engagement.

4. The bucket arrangement of claim 3 wherein each of said tooth assemblies includes a tooth adapter attached to said cutting edge plate and a tooth detachably carried on said tooth adapter.

5. The bucket arrangement of claim 4 wherein said leading edge of said cutting edge plate has an acute bevel along its length.

* * * * *